United States Patent [19]

Ishizaki

[11] 4,280,255

[45] Jul. 28, 1981

[54] BUTTON

[76] Inventor: Hidenosuke Ishizaki, 6-13, 6-chome, Motoyamakita-machi, Higashinada-ku, Kobe-shi, Japan

[21] Appl. No.: 122,185

[22] Filed: Feb. 19, 1980

[51] Int. Cl.[3] ..... A44B 1/42

[52] U.S. Cl. ..... 24/95; 24/96

[58] Field of Search ..... 24/94, 95, 96

[56] References Cited

U.S. PATENT DOCUMENTS

| | | | |
|---|---|---|---|
| 1,434,491 | 11/1922 | Hubbell | 24/94 |
| 1,718,843 | 6/1929 | White et al. | 24/94 |
| 1,968,221 | 7/1934 | Reiter | 24/94 |
| 4,084,295 | 4/1978 | Ishizaki | 24/95 |
| 4,197,617 | 4/1980 | Appelt | 24/95 X |

FOREIGN PATENT DOCUMENTS

| | | | |
|---|---|---|---|
| 827419 | 1/1952 | Fed. Rep. of Germany | 24/94 |
| 2637156 | 2/1978 | Fed. Rep. of Germany | 24/94 |

*Primary Examiner*—Roy D. Frazier
*Assistant Examiner*—Peter A. Aschenbrenner
*Attorney, Agent, or Firm*—Larson and Taylor

[57] ABSTRACT

A button comprises a button face member; a support plate having a center hole for supporting the face member; a hollow shank having upper and lower open ends, a constricted neck at its upper portion and a shoulder extending downward from the neck, the neck having a smaller diameter than the hole, the shoulder having a larger diameter than the hole; a bending guide member in the form of a ball disposed within the shank and having a spherical surface; an engaging member having a center bore extending therethrough and disposed within the shank under the guide member; and a fastening member having a piercing needle. The support plate is loosely fitted around the neck and prevented from slipping off by an enlarged top portion formed at the upper end of the neck after the support plate has been loosely fitted around the neck. The support plate and the face member fitted over the plate form a button head, which is pivotably turnably supported by the shank. The shank is fastened to a fabric by the piercing needle of the fastening member.

3 Claims, 12 Drawing Figures

BUTTON

The present invention relates to buttons, and more particularly to improvement in buttons which comprise a button shank and a button head pivotably turnably mounted on the upper end of the button shank and which are convenient to use, such that the button main body can be easily and efficiently attached to a fabric without resorting to sewing.

Generally buttons are so designed that the button head is sewn to a fabric as positioned close thereto. Thus it is difficult to smoothly pass the button through a buttonhole. This difficulty increases in the case where the buttonhole is formed in a thick fabric such as an overcoat fabric or in a hard fabric as in jeans.

To overcome the above-mentioned drawback, various buttons have been provided which include an elongated button shank and which can be passed through the buttonhole with greater ease. With most of the buttons of this type, however, the button head is secured to the shank and is not pivotable or turnable independently of the shank. Thus they still involve difficulty in being passed through the buttonhole as smoothly as is desired.

Furthermore because buttons are usually sewn to a fabric, they are cumbersome to secure to the fabric and are liable to come off the place when the sewing thread is worn away or inadvertently cut.

In recent years, buttons of another type have been developed which include an elongated shank formed with a threaded bore and a fastening member provided with a threaded stem so that the button can be attached to the fabric by screwing the fastening member into the threaded bore without resorting to sewing. The buttons of this type are therefore convenient to secure to the fabric but still have the drawback that the button tends to come off when the fastening member loosens.

In order to covercome the above drawbacks, I have already invented a button comprising a button face member; a support plate having a center hole for supporting the face member; a hollow button shank having upper and lower open end, a constricted neck at its upper portion and a shoulder extending downward from the constricted neck, the neck having a smaller diameter than the center hole, the shoulder having a larger diameter than the center hole; a bending guide member disposed within the shank and having a slanting surface at its bottom for bending and guiding; an engaging member having a center bore extending therethrough and disposed within the shank and under the bending guide member; and a fastening member having a piercing needle. The support plate is loosely fitted around the neck of the shank and retained thereon by an enlarged top portion formed at the upper end of the neck after the support plate has been loosely fitted around the neck. The support plate and the button face member fitted over the support plate form a button head, which is therefore pivotably turnably supported by the shank with the enlarged top portion of the shank positioned within the space defined by the face member and the support plate. The button main body is fastened to a fabric or like sheet-like material by the piercing needle of the fastening member.

This button nevertheless still has other drawbacks. The bending guide member having a slanting surface at its bottom is extremely difficult to make and is not suited to quantity production, hence a high manufacturing cost. Additionally since the bending and guiding bottom surface slants in a particular direction, the piercing needle of the fastening member is bent and guided only in that direction when forced against the slanting surface. Thus the needle can not always be bent smoothly and properly.

The main object of this invention is to provide a button comprising a button head which is pivotably turnably mounted on a slightly elongated button shank and which can be passed through a buttonhole smoothly and easily because it is freely pivotable and turnable, even when the buttonhole is formed in a thick or hard fabric.

Another object of this invention is to provide a button which can be easily secured to a fabric without resorting to sewing in any way or to screw-thread engagement and which, when secured to a fabric, can be held in place with much greater strength than various known buttons free of any possibility of coming off during use.

The button of this invention comprises a button face member; a support plate having a center hole for supporting the face member; a hollow button shank having upper and lower open ends, a constricted neck at its upper portion and shoulder extending downward from the constricted neck, the neck having a smaller diameter than the center hole, the shoulder having a larger diameter than the center hole; a bending guide member in the form of a ball disposed within the shank and having a bending and guiding spherical surface; an engaging member having a center bore extending therethrough and disposed within the shank and under the bending guide member; and a fastening member having a piercing needle.

The support plate is loosely fitted around the neck of the shank and prevented from slipping off by an enlarged top portion formed at the upper end of the neck after the support plate has been loosely fitted around the neck. The support plate and the button face member fitted over the support plate form a button head, which is pivotably turnably supported by the shank with the enlarged top portion of the shank positioned within the space defined by the face member and the support plate. The button main body is fastened to a fabric or sheet-like material by the piercing needle of the fastening member.

With the button of this invention having the foregoing structure, the button head composed of a face member and a support plate loosely fitting around the constricted neck of the button shank is smoothly pivotable and turnable, because the enlarged top portion of the button shank is positioned within the space defined by the face member and the support plate. Accordingly the button can be smoothly and easily passed through a buttonhole even if the buttonhole is formed in a thick fabric as in an overcoat, or in a hard fabric is in jeans, with the result that the garment can be put on or taken off easily and quickly, with a reduced possibility of damaging the portion of the fabric defining the buttonhole.

The button of this invention has another advantage that it can be secured to the fabric very easily and firmly without resorting to sewing in any way but merely by placing the button shank on the front surface of the fabric with the bottom of the engaging member in contact with the fabric, inserting the piercing needle of the fastening member into the bore of the engaging member from the rear surface of the fabric and forcing the needle into the shank. Stated more specifically the end of the piercing needle inserted into the bore of the engaging member is forced against the spherical surface of the bending guide member in the form of a ball and housed in the shank, whereby the needle is bent and guided sidewise along the spherical surface. Consequently the needle is immovably engaged by the slanting surface of the guide member and by the engaging member. Unlike the case in which buttons are attached to the fabric by sewing or screw-thread engagement, the button of this invention can be secured in place with extreme ease free of any possibility of coming off.

With the button of this invention, balls commercially available, for example, for ball bearings are usable as the ball serving as the member for guiding and bending the piercing needle, with the resulting advantage that balls of the desired size are available inexpensively. Buttons can therefore be manufactured at reduced costs. Since the piercing needle is bent by striking contact with the spherical surface not in a particular direction but in any direction in accordance with the position of the striking contact, and further since the spherical surface is slippery, the piercing needle can be bent and guided very smoothly without any failure. These are distinct features of this invention.

This invention will be described below in greater detail with reference to the accompanying drawings, in which.

Figure 1:
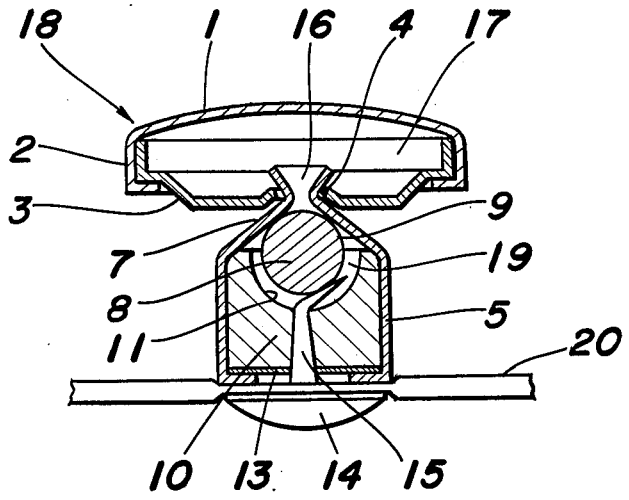
FIG. 1 is a view partly in vertical section and showing a button of the invention as attached to a fabric and assembled from the components shown in FIGS. 2 to 12.
Figure 2:
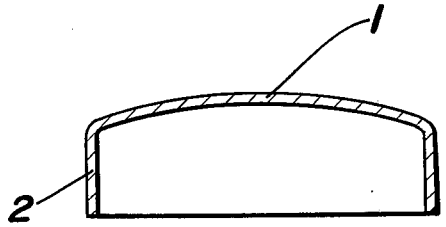
FIG. 2 is a view in vertical section showing a button face member.
Figure 4:
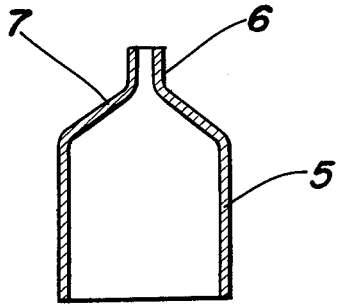
FIG. 4 is a view in vertical section showing a button shank.

With reference to the drawings, the button of this invention comprises a button face member 1, a support plate 3 for the button face member, a button shank 5, a bending guide member 8, an engaging member 10, a bottom plate 13 and a fastening member 14.

The button face member 1 is in the form of a chromium-plated metal plate having a circular shape in plan view and including a peripheral wall 2 to be crimped.

Figure 3:
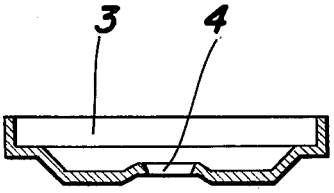
FIG. 3 is a view in vertical section showing a support plate for the button face member.
Figure 5:
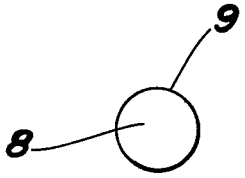
FIG. 5 is a front view of a bending guide member.
Figure 9:
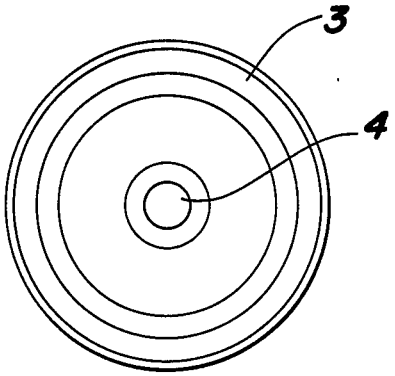
FIG. 9 is a plan view showing the support plate for the button face member.

The support plate 3 for the button face member is in the form of a metal plate circular in plan view and having a center hole 4. As seen in FIGS. 3 and 9, the support plate 3 has a peripheral portion which is positioned at a slightly higher lever than its center portion.

The button shank 5 is a hollow member having upper and lower open ends and made from a metal sheet by press work. The button shank 5 has at its upper portion a constricted neck 6 having a predetermined length and a smaller diameter than the center hole 4. A shoulder portion 7 extending downward from the constricted neck 6 has a larger diameter than the center hole 4.

The bending guide member 8 is in the form of a ball having a bending and guiding spherical surface 9 and made of steel.

Figure 6:
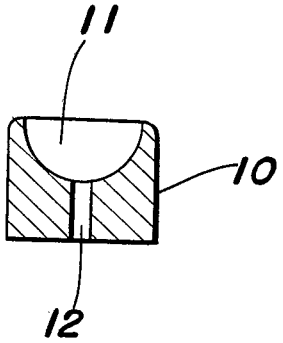
FIG. 6 is a view in vertical section showing an engaging member.
Figure 11:
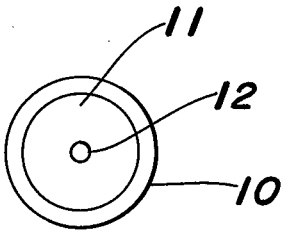
FIG. 11 is a plan view of the engaging member.
Figure 12:
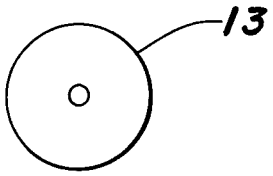
FIG. 12 is a plan view showing a bottom plate.

As seen in FIGS. 6 and 11, the engaging member 10 comprises a solid cylinder having a semispherical recessed surface 11 in its upper portion and a center bore 12 extending therethrough. The engaging member 10 is made from rigid plastics or from the same material as the bending guide member 8.

The bottom plate 13 is a steel disc having a center aperture.

Figure 7:
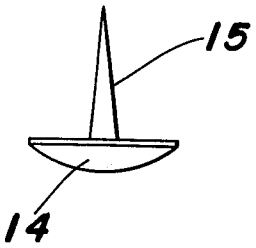
FIG. 7 is a front view showing a fastening member.
Figure 10:
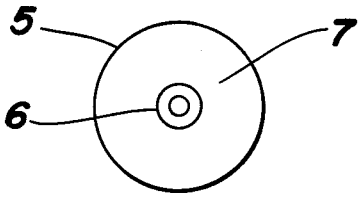
FIG. 10 is a plan view showing the button shank.
Figure 8:
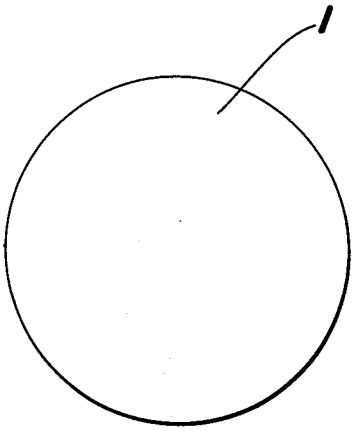
FIG. 8 is a plan view showing the button face member.

The fastening member 14 comprises a fastening disc and a piercing needle 15 projecting from the center of the disc. The needle 15 is made from a metal material which is not easily bendable but can be bent by a considerably great force (FIG. 7).

The parts described above will be assembled into a button, for example, in the following manner.

The constricted neck 6 of the button shank 5 is inserted into the center hole 4 of the support plate 3 to loosely fit the support plate 3 around the neck 6. The open upper end of the neck 6 is then enlarged radially outward thereof to form an enlarged top portion 16, which prevents the support plate 3 from slipping off.

The button face member 1 is fitted over the support plate 3, and the peripheral wall 2 of the member 1 is crimped inward over the plate 3, whereby the button face member 1 is held to the support plate 3 to provide a button head 18 having an interior space 17. With the enlarged top portion 16 of the button shank 5 thus positioned within the space 17, the button head 18 is pivotably turnably retained on the button shank 5.

The bending guide member 8, the engaging member 10 and the bottom plate 13 are placed into the button shank 5 one after another. The upper peripheral portion of the engaging member 10 is held against the inner surface of the shoulder portion 7 of the shank 5, while the bending guide member 8 is loosely placed between the engaging member 10 and the shank 5 so that a clearance 19 can be formed between the bending guide member 8 and the recessed surface of the engaging member 10. The lower end of the shank 5 is then crimped inward over the bottom peripheral portion of the plate 13 to enclose the members 8 and 10 and the bottom plate 13 within the button shank 5.

The button main body thus assembled is attached to a fabric 20 by the fastening member 14 in the mode illustrated in FIG. 1. The bottom of the plate 13 enclosed in the button shank 5 is placed on the front surface of the fabric 20, and the piercing needle 15 of the fastening member 14 is inserted into the bore 12 in the engaging member 10 from the rear surface of the fabric and forced into the button shank 5. The end of the needle 15 is thereby forced against the spherical surface 9 of the bending guide member 8 in the form of a ball and housed in the button shank 5, whereby the needle is smoothly bent and guided in a direction along the spherical surface 9. Consequently the needle is held in a bent form between the spherical surface 9 of the guide member 8 and the recessed surface 11 of the engaging member 10 with a clearance 19 formed therebetween. In this way, the button can be attached to the fabric reliably.

Although the present invention has been described above with reference to a principal embodiment, the invention is not limited to the embodiment which is given for illustrative purposes only.

For example, instead of forming an enlarged top portion on the constricted neck of the button shank, a plug or like enlarged member may be provided at the open upper end of the neck.

Other changes and modifications of this invention may be made by one skilled in the art without departing from the scope of the invention as defined in the appended claims.

What is claimed is:

1. A button comprising:

a button face member, a support plate having a center hole for supporting the face member, a hollow button shank having upper and lower open ends, a constricted neck at its upper portion and a shoulder extending downward from the constricted neck, the neck having a smaller diameter than the center hole, the shoulder having a larger diameter than the center hole, a bending guide member in the form of a ball disposed within the shank and having a bending and guiding spherical surface;

an engaging member having a center bore extending therethrough and disposed within the shank and under the bending guide member, and a fastening member having a piercing needle, the support plate being loosely fitted around the neck of the shank and prevented from slipping off by an enlarged top portion formed at the upper end of the neck after the support plate has been loosely fitted around the neck, the button face member being fitted over the support plate to form a button head from the face member and the support plate, the button head being pivotably turnably supported by a shank with the enlarged top portion of the shank positioned within the space defined by the face member and the support plate, the shank being fastenable to a fabric or like sheetlike material by the piercing needle of the fastening member.

2. A button as defined in claim 1 wherein the enlarged top portion of the shank is formed by enlarging the open upper end of the neck radially outwardly thereof.

3. A button as defined in claim 1 wherein the enlarged top portion of the shank is formed by providing an enlarged member at the open upper end of the neck.

* * * * *